US007523903B1

(12) United States Patent
Rindoks et al.

(10) Patent No.: US 7,523,903 B1
(45) Date of Patent: Apr. 28, 2009

(54) SHELF SUPPORT SYSTEM

(75) Inventors: Kurt P. Rindoks, Davidson, NC (US); Steven Huggins, Statesville, NC (US)

(73) Assignee: Kewaunee Scientific Corporation, Statesville, NC (US)

( * ) Notice: Subject to any disclaimer, the term of this patent is extended or adjusted under 35 U.S.C. 154(b) by 0 days.

(21) Appl. No.: 12/002,955

(22) Filed: Dec. 19, 2007

(51) Int. Cl.
*E04G 3/20* (2006.01)

(52) U.S. Cl. ..... 248/250; 211/187

(58) Field of Classification Search ..... 248/250, 248/235; 211/187, 186, 90.02, 190; 108/108
See application file for complete search history.

(56) References Cited

U.S. PATENT DOCUMENTS

| | | | | | |
|---|---|---|---|---|---|
| 2,790,559 | A | | 4/1957 | Stephenson et al. | 211/136 |
| 2,845,187 | A | | 7/1958 | Bianchi | 211/136 |
| 2,912,119 | A | | 11/1959 | Robinson | 211/136 |
| 2,940,601 | A | | 6/1960 | Smith | 211/93 |
| 2,940,603 | A | | 6/1960 | Riedmaier et al. | 211/136 |
| 3,115,972 | A | | 12/1963 | Schild | 211/149 |
| 4,018,167 | A | | 4/1977 | Spangler | 108/152 |
| 4,938,442 | A | * | 7/1990 | Mastrodicasa | 248/250 |
| 5,205,421 | A | * | 4/1993 | Bustos | 211/59.2 |
| 5,297,486 | A | * | 3/1994 | Herrmann et al. | 108/108 |
| 5,405,114 | A | | 4/1995 | Dias | 248/250 |
| 5,406,894 | A | | 4/1995 | Herrmann et al. | 108/108 |
| 6,520,353 | B2 | | 2/2003 | Fulbright | 211/153 |
| 2004/0173549 | A1 | * | 9/2004 | Herron et al. | 211/90.02 |
| 2006/0113443 | A1 | | 6/2006 | Remmers | 248/235 |
| 2006/0213849 | A1 | | 9/2006 | Bienick | 211/90.02 |
| 2006/0266901 | A1 | * | 11/2006 | Tallman | 248/220.43 |

FOREIGN PATENT DOCUMENTS

| | | | |
|---|---|---|---|
| JP | 02001000288 | A | 1/2001 |
| JP | 02006280810 | A | 10/2006 |

* cited by examiner

*Primary Examiner*—Ramon O Ramirez
(74) *Attorney, Agent, or Firm*—K&L Gates LLP

(57) ABSTRACT

A shelf support system that includes a shelf member having a flat support surface, and a flange adjacent at least one end of the support surface that includes a downwardly extending wall portion and an inwardly extending wall portion connected thereto, the inwardly extending wall portion having an edge formed with a notch having a predetermined width. At least one support bracket includes a U-shaped mounting flange having an upwardly extending connecting wall that includes a spacer wall portion having a predetermined width and an engagement wall portion that is connected to the spacer wall portion and that extends beyond the predetermined width of the spacer wall portion. The support bracket is connected to the shelf member by positioning the U-shaped mounting flange of the support bracket within the wall portions of the shelf member to provide a secure connection without the use of tools.

10 Claims, 6 Drawing Sheets

SHELF SUPPORT SYSTEM

BACKGROUND OF THE INVENTION

The present invention relates generally to support systems for shelves and the like, and more particularly to systems of this type that can be installed without tools.

There are a wide variety of shelf support systems that are designed to permit a shelf or similar support surface to be installed in place, usually by securing the shelf to a support, such as a stanchion. In many systems of this type, it is necessary to use attachment devices, such as screws, bolts and the like, to obtain a secure connection between the shelf and its support. While these systems do generally provide a proper support for the shelf, they must be manually installed using tools which is time consuming, labor intensive and expensive. Moreover, in time the attachment devices may loosen, which adversely affects the secure connection that supports the shelf.

It is also known to provide self support systems that do not require any special tools to install the shelf, but these systems are relatively complex in structure and difficult to install, and they therefore are relatively expensive. Additionally, in some cases there is not a tight fit between the shelf and its support.

Therefore, there exists a need for a shelf support system that can be installed easily and quickly without the need for tools or manually installed attachment devices, and that provides a secure and tight fitting support for the shelf.

SUMMARY OF THE INVENTION

Briefly summarized, the present invention provides a shelf support system that includes a shelf member having a longitudinally extending support surface, and a flange adjacent at least one end of the support surface. The flange includes a downwardly extending wall portion and an inwardly extending wall portion connected thereto, with the inwardly extending wall portion having an edge formed with a notch having a predetermined width. The support system: also includes at least one support bracket for selective attachment to the one end of the shelf member, the support bracket including a generally U-shaped mounting flange having an upwardly extending connecting wall that includes a spacer wall portion having a predetermined length and an engagement wall portion that is connected to the spacer wall portion and that extends beyond the predetermined length of the spacer wall portion. The length of the spacer wall portion of the support bracket is less that the width of the notch in the shelf member to permit the U-shaped mounting flange of the support bracket to engage the downwardly extending wall portion and the inwardly extending wall portion of the shelf member, with the spacer wall portion of the support bracket disposed in the notch of the shelf member and with the engagement wall portion engaging the inwardly extending wall portion of the shelf member to provide a secure connection between the shelf member and the support bracket.

In the preferred embodiment of the present invention, the shelf member includes a second flange adjacent the other end of the support surface having a downwardly extending wall portion and an inwardly extending wall portion connected thereto, with the inwardly extending wall portion having an edge formed with a notch having a predetermined width, and the system includes a second support bracket which is the mirror image of the one support bracket and which is connectable to the second flange of the shelf member in the same manner that the one support bracket is connected to the flange at the one end of the shelf member.

It is also preferred that the length of the spacer wall portion of the support bracket be just slightly less than the length of the notch to provide a close fit therebetween when the support bracket is connected to the shelf member, and that the engagement wall portion of the support bracket extends beyond the length of the spacer wall portion on both sides thereof at a gradually increasing incline with respect to the inwardly extending wall portion of the shelf member when the support bracket is connected to the shelf member.

The U-shaped mounting flange of the support bracket may include a generally horizontally extending wall portion connected to the upwardly extending connection wall, and the width of the horizontally extending wall portion may be substantially equal to the width of the inwardly extending wall portion of the shelf member at the location of the notch. Also, the width of the inwardly extending wall portion of the shelf member at locations other than the notch are preferably greater than the width of the horizontally extending wall portion of the U-shaped mounting flange.

The support bracket may include a vertically extending attachment wall having attachment means for connecting the support bracket to a stanchion, and the U-shaped mounting flange of the support bracket may be connected to the bottom end of the attachment wall.

The present invention also provides a method of mounting a shelf member on a support comprising the steps of providing a shelf member and at least one support bracket as described above; manipulating the support bracket and the shelf member to insert the connecting wall of the support bracket into flange of the shelf member with the spacer wall portion and engagement wall portion initially lying at an angle relative to the inwardly extending wall portion of the shelf member and with the spacer wall portion located adjacent the notch in the inwardly extending wall portion of the shelf member; then rotating the support bracket relative to the shelf member to cause the spacer wall portion to move into the notch and to cause the engagement wall portion to engage the inwardly extending wall portion of the shelf member at each side of the notch to thereby provide a secure connection between the shelf member and the support bracket; and connecting the support bracket to a support.

Preferably, the method includes providing the shelf member with two flanges located at opposed ends of the shelf member; providing two support brackets; connecting one of the support brackets to one of the flanges of the shelf member and connecting the other support bracket to the other flange of the shelf member, and connecting the two support brackets to two stanchions spaced from one another.

DESCRIPTION OF THE PREFERRED EMBODIMENT

Figure 1:
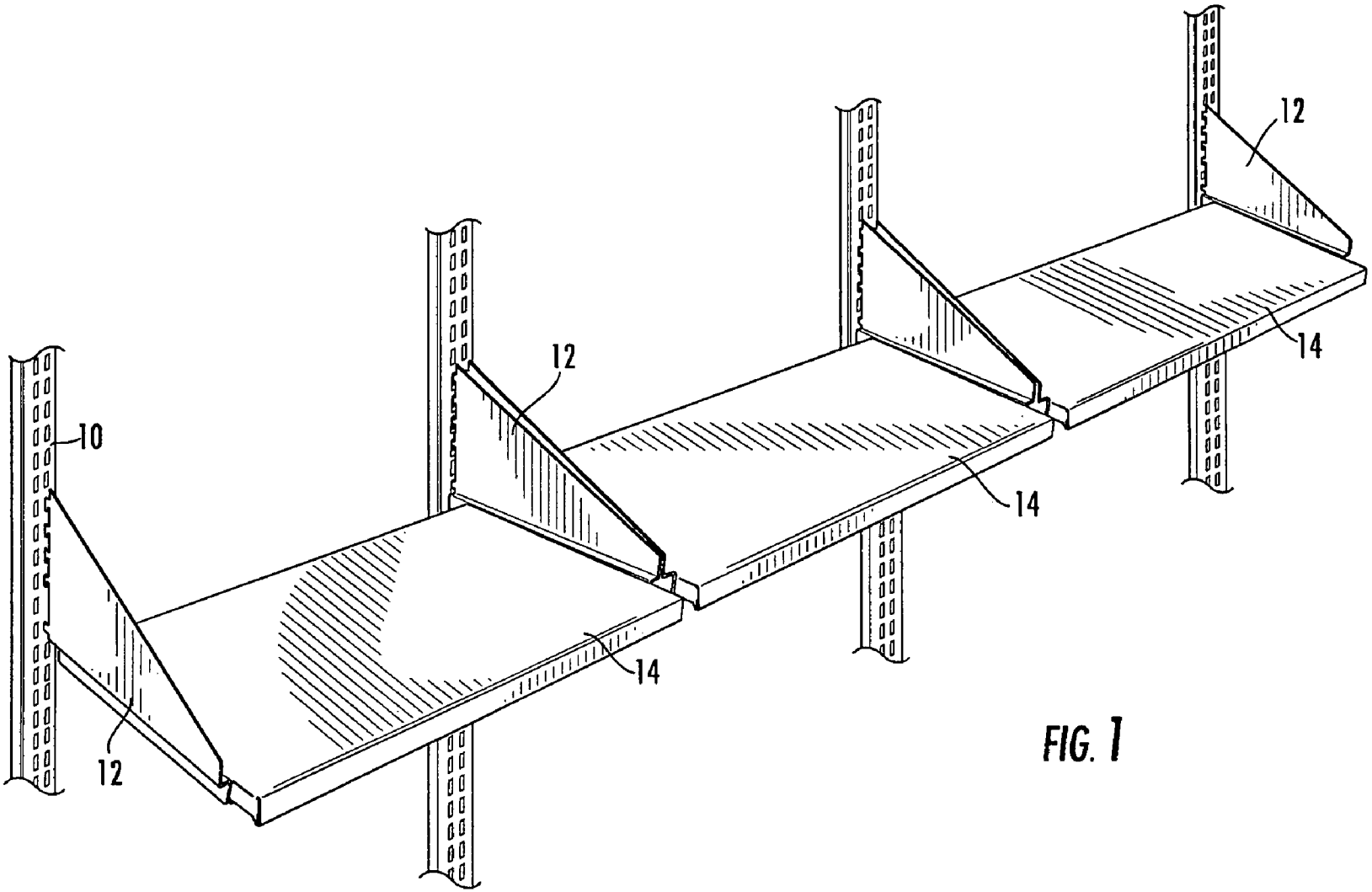
FIG. 1 is perspective view of a preferred embodiment of an array of shelf support systems of the present invention mounted on vertical stanchions.

Looking now in greater detail at the accompanying drawings which illustrate one preferred embodiment of the present invention, FIG. 1 illustrates a shelf support system which includes a plurality of conventional vertical support stanchions 10 on which are mounted three pairs of support brackets 12 and three shelf members 14 which are supported by the support brackets 12. In most applications of the present invention, it is believed that better support for a shelf member 14 is obtained using two support brackets 12, one at each end of the shelf member 14 as will be described in greater detail below. However, it is also to be understood that in some applications where there is a light load to be placed on the shelf member 14, or where there is very limited space, it will be possible to support the shelf member using only one support bracket 12 at one end of the shelf member 14, with the shelf member 14 extending out from the support bracket 12 in cantilever fashion.

Figure 2:
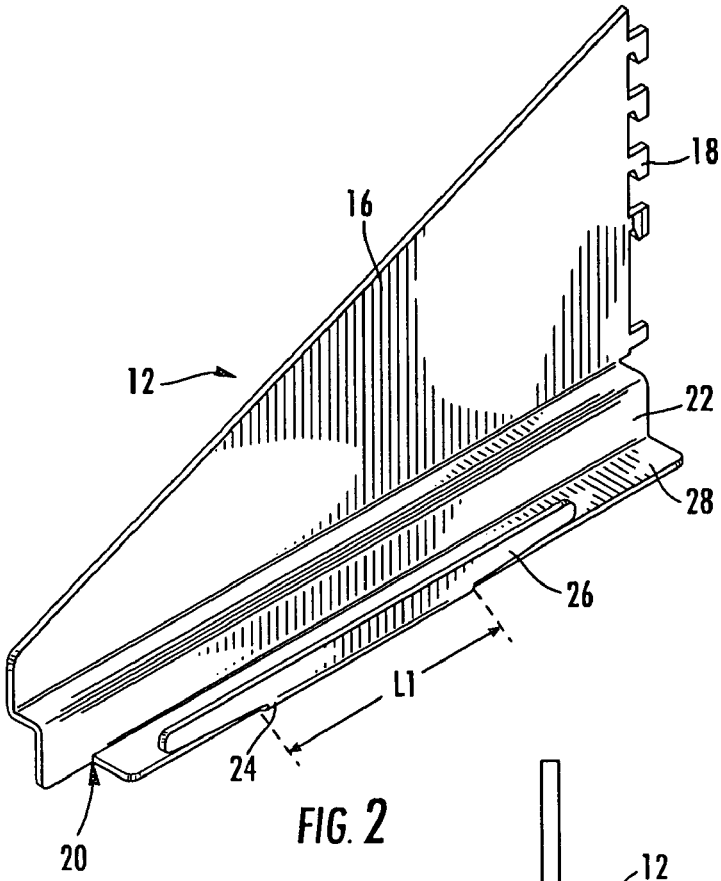
FIG. 2 is a perspective view of a support bracket.
Figure 3:
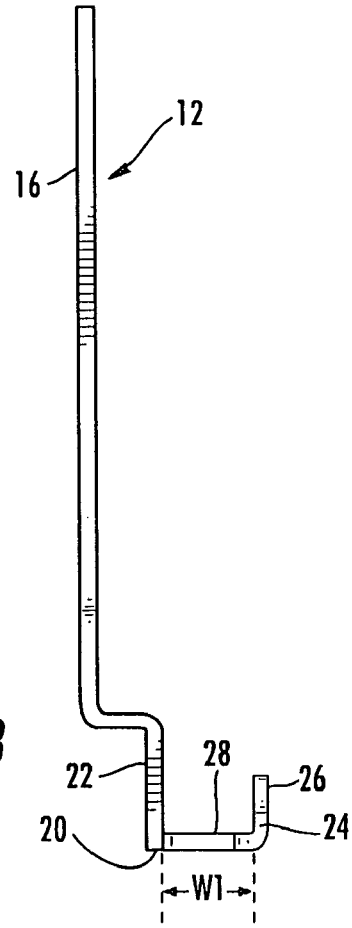
FIG. 3 is a side view of the support bracket illustrated in FIG. 2.

One of the support brackets 12 is illustrated in FIGS. 2 and 3, and it includes a vertically extending wall 16 having a plurality of conventional hooks 18 extending outwardly from one edge thereof, these hooks forming a conventional attachment with the vertical stanchions 10. It will be understood that the details of the hook and slot attachment between the support brackets 12 and the stanchions 10 are not part of the present invention, and there are a variety of known attachment systems similar to the hook and slot attachment could be used in securing the support brackets to the stanchions 10. The support bracket 12 also includes a generally U-shaped mounting flange 20 connected to the bottom of the attachment wall 16, and this U-shaped mounting flange 20 includes an upwardly extending connecting wall 22 formed with a spacer wall portion 24 connected to an engagement wall portion 26 which extends beyond the width of the spacer wall portion 24 at both sides thereof. The U-shaped mounting flange 20 also includes a horizontally extending wall portion 28 which is connected to the spacer wall portion 24.

Figure 4:
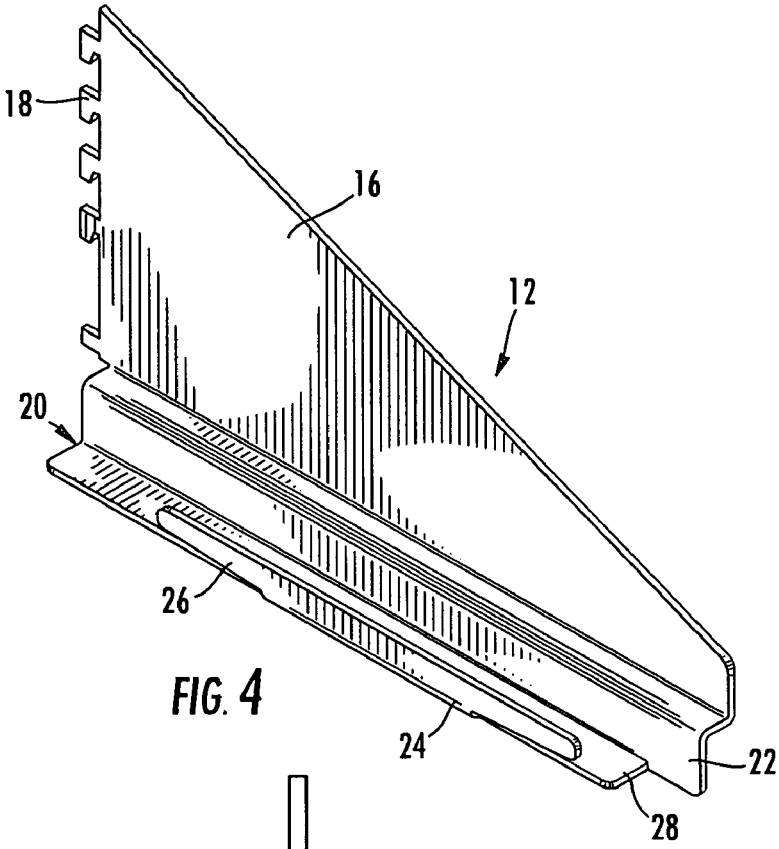
FIG. 4 is a perspective view of another support bracket that is the mirror image of the support bracket illustrated in FIG. 2.
Figure 5:
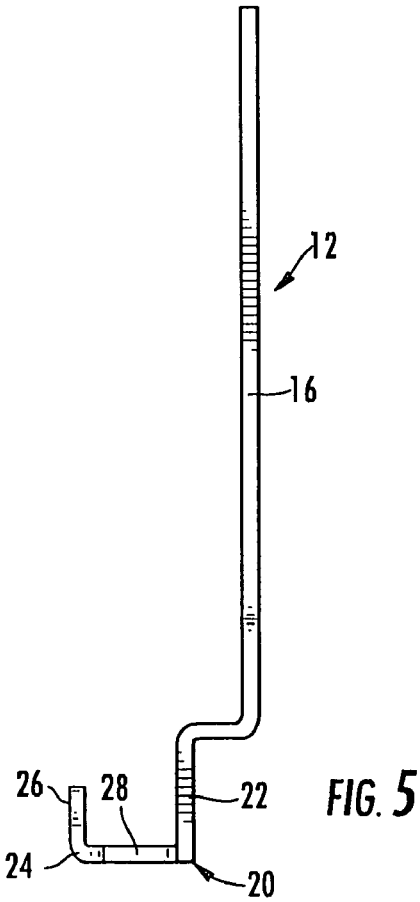
FIG. 5 is side view of the support bracket illustrated in FIG. 4.

Another support bracket 12 is illustrated in FIGS. 4 and 5, and this support bracket 12 is identical to the support bracket described above in connection with FIGS. 2 and 3, except that it is the mirror image thereof. Accordingly, since the structure of the two support brackets 12 illustrated in FIGS. 2 and 3 and in FIGS. 4 and 5 is identical, except for the fact that one is the mirror image of the other, the same reference numerals described above in connection with the support bracket 12 illustrated in FIGS. 2 and 3 have also been used in the support bracket 12 illustrated in FIGS. 4 and 5.

Figure 6:
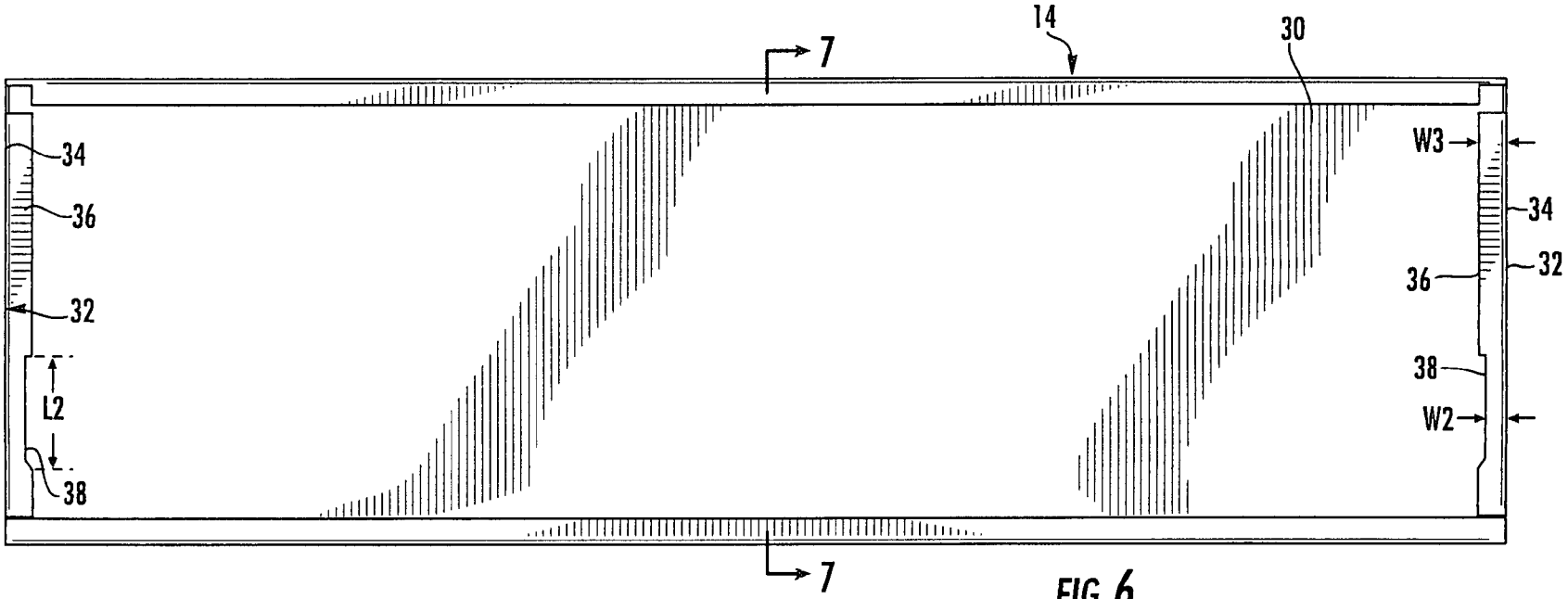
FIG. 6 is a bottom plan view of a shelf member.
Figure 7:
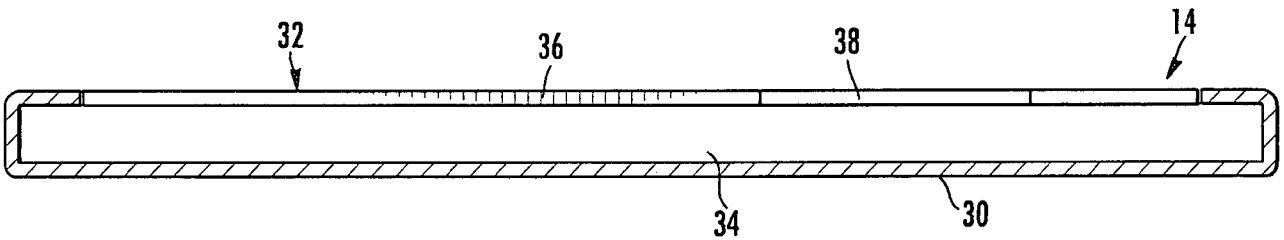
FIG. 7 is an end view of the shelf member illustrated in FIG. 6.

The shelf member 14, which is best illustrated in FIGS. 6 and 7, includes a longitudinally extending support surface 30, which is preferably generally flat, and it includes a flange 32 adjacent each of the opposite ends of the support surface 30. Each flange 32 includes a downwardly extending wall portion 34 connected to an inwardly extending wall portion 36, and the edge of the inwardly extending wall portion 36 is formed with a notch or indentation 38.

When the shelf member 14 is mounted to one or two of the support brackets 12 in a manner to be described in greater detail below, the exact dimensions of the interacting parts of the support brackets 12 and the shelf member 14 are not critical, and the shelf member 14 will be properly supported if the dimensions vary through an acceptable range of tolerances. However, it has been found that in most applications, a more secure and tighter connection between the support brackets 12 and the shelf member 14 may be obtained if certain dimensional relationships are incorporated into the interacting parts. Therefore, in the preferred embodiment of the present invention, the length (L1) of the spacer wall portion 24 of the support bracket 12 (see FIG. 2) is substantially equal to, but slightly less than, the length (L2) of the notch 38 in the inwardly extending wall portion 36 of the support bracket 12 (see FIG. 6). Additionally, it is preferred that the width W1 of the horizontal wall portion 28 of the support brackets 12 (see FIG. 3) is substantially equal to, but lightly greater than, the width W2 of the inwardly extending wall portion 36 of the support bracket 12 at the point where the notch 38 is located (see FIG. 6) and is also slightly less than the width (W3) of the inwardly extending wall portion 36 at locations other than at the notch 38 (see FIG. 6).

Figure 8:
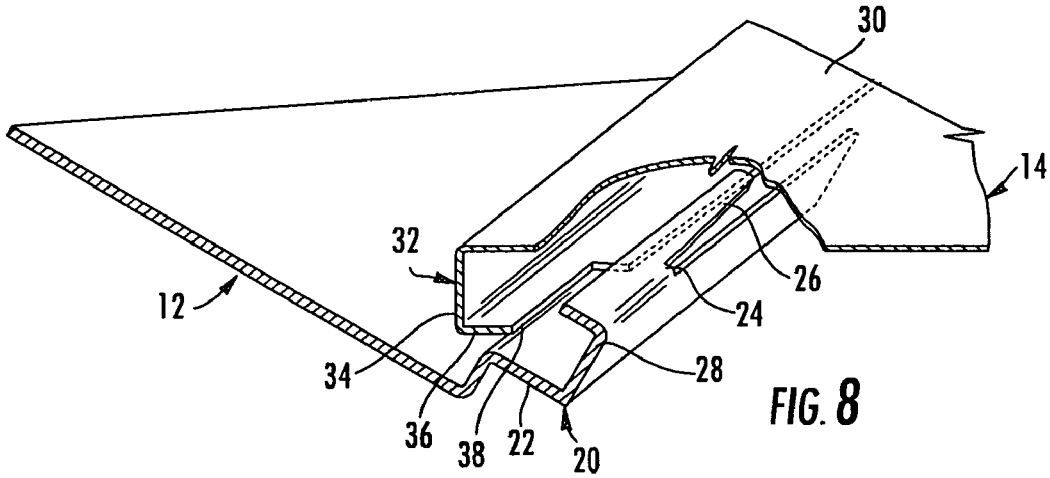
FIGS. 8-11 illustrate a sequence of steps for connecting a support bracket to the shelf member.
Figure 9:
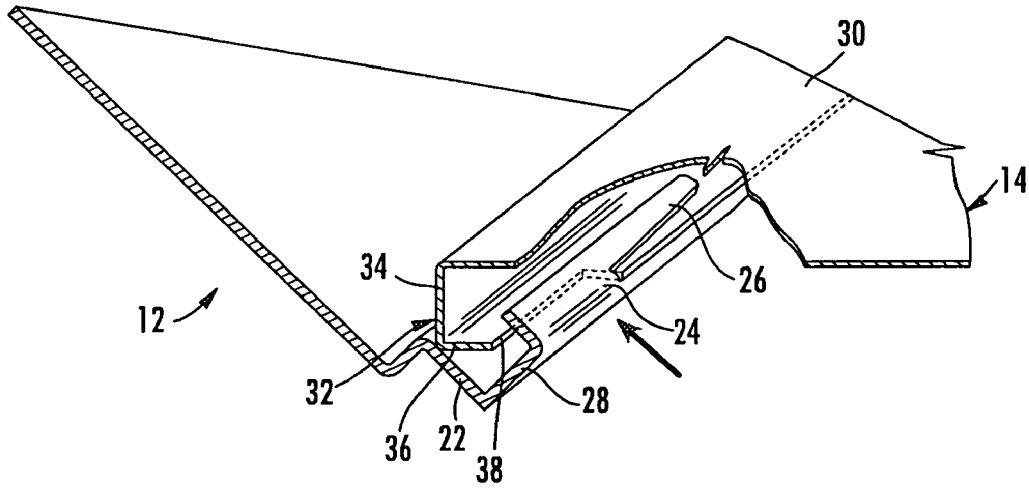
Figure 10:
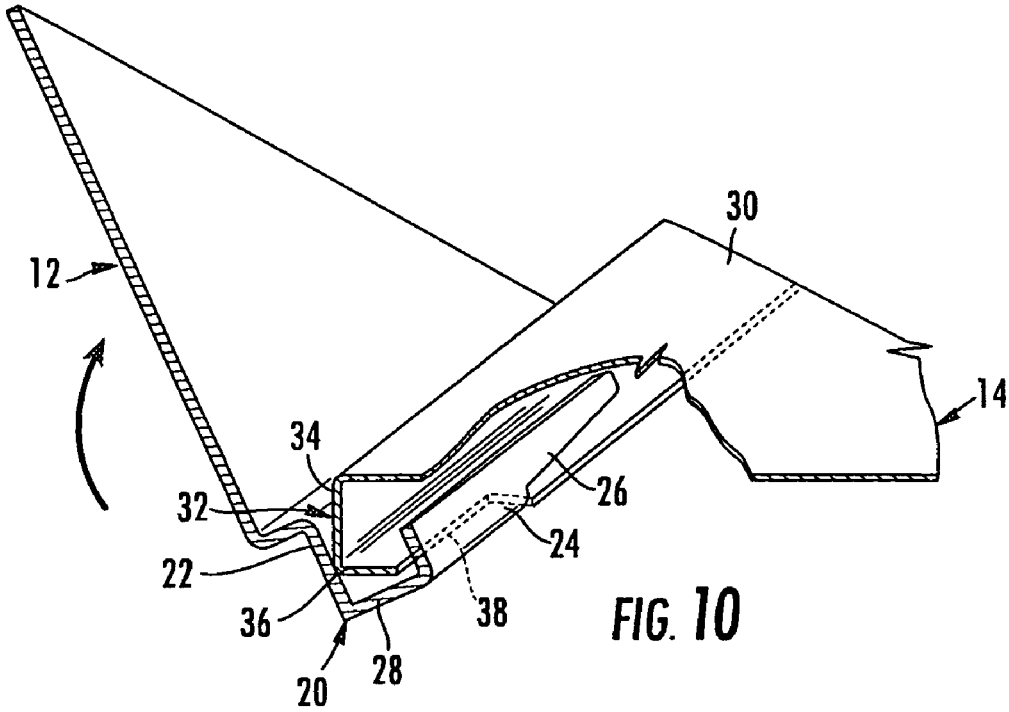
Figure 11:
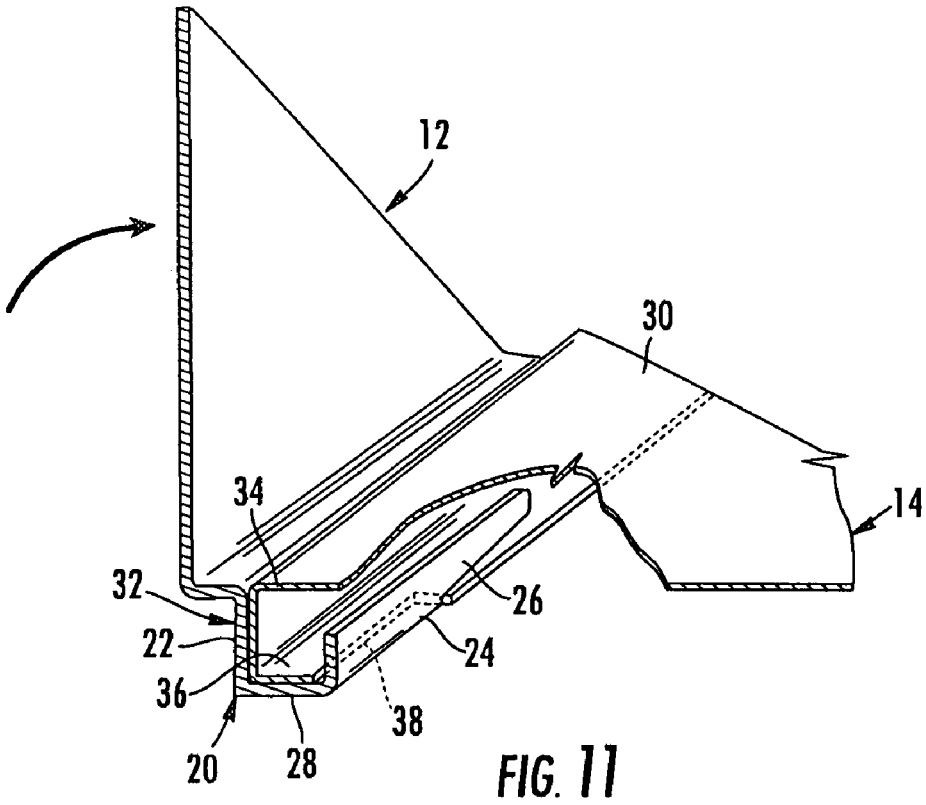

The preferred method of mounting the shelf member 14 on one of the support brackets 12 is illustrated in FIGS. 8-11. As shown in FIGS. 8 and 9, the support bracket 12 is manipulated relative to the shelf member 14 so that the U-shaped mounting flange 20 of the support bracket 12 is moved at an angle to the flange 32 at one end of the shelf member 14 until the spacer wall portion 24 of the support bracket 12 is generally aligned with the notch 38 in the inwardly extending wall portion 36 of the shelf member 14. As seen in FIGS. 10 and 11, the support bracket 12 is then partially rotated relative to the shelf member 14 until downwardly extending wall portion 34 and the inwardly extending wall portion 36 of the shelf member 14 abut the upwardly extending wall portion 22 and the horizontally extending wall portion 28 of the support bracket 12, respectively. At this position, the spacer wall portion 24 of the support bracket 12 is positioned within the confines of the notch 38, and the engagement wall portion 26 of the support bracket 12 engages the inwardly extending wall portion 36 of the shelf member 14 at the edges of the spacer wall portion 24. The second support bracket 12 can then be mounted to the other end of the shelf member 14 using the same sequence of steps. In the embodiment of the present invention shown in the drawings and described above, each of the inwardly extending walls 36 of the shelf member 14 is formed with only one notch 38, and each support bracket 12 is provided with one cooperating engagement wall portion 26. However, it will be understood that more than one notch and cooperating engagement wall portion can be provided, if desired, in the support bracket 12 and the shelf member 14 in different applications of the present invention.

Accordingly, it will be appreciated that shelf member 14 may be quickly and easily mounted to one or two support brackets 12 by a simple manipulation of the support brackets 12 relative to the shelf member 14, all without requiring a tool of any kind. The shelf member 14 can also be easily and quickly disconnected from the support brackets by simply reversing the steps of the mounting operation. Moreover, when the shelf member 14 is mounted to one of the support brackets 12 as best illustrated in FIG. 11, there is a very secure and tight fitting connection between the unshaped mounting flange 20 of the support brackets 12 and the flange 32 at each end of the shelf member 14.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A shelf support system that includes:

(a) a shelf member that includes a longitudinally extending generally flat support surface, and a flange adjacent at least one end of the support surface, the flange including a downwardly extending wall portion and an inwardly extending wall portion connected thereto, with the inwardly extending wall portion having an edge formed with a notch having a predetermined width;

(b) at least one support bracket for selective attachment to the one end of the shelf member, the support bracket including a generally U-shaped mounting flange having an upwardly extending connecting wall that includes a spacer wall portion having a predetermined width and an engagement wall portion that is connected to the spacer wall portion and that extends beyond the predetermined width of the spacer wall portion; and (c) wherein the width of the engagement wall portion is less that the width of the notch in the shelf member to permit the U-shaped mounting flange of the support bracket to engage the downwardly extending portion and the inwardly extending portion of the shelf member with the spacer wall portion of the support bracket disposed in the notch of the shelf member and with the engagement wall portion engaging the inwardly extending wall portion of the shelf member to provide a secure connection between the shelf member and the support bracket.

2. A shelf support system as defined in claim 1, wherein the shelf member includes a second flange adjacent the other end of the support surface having a downwardly extending wall portion and an inwardly extending wall portion connected thereto, with the inwardly extending wall portion having an edge formed with a notch having a predetermined width, and wherein the system includes a second support bracket which is the mirror image of the one support bracket and which is connectable to the second flange of the shelf member in the same manner as the one support bracket is connected to the flange at the one end of the shelf member.

3. A shelf support system as defined in claim 1, wherein the width of the spacer wall portion is just slightly less than the width of the notch to provide a close fit therebetween when the support bracket is connected to the shelf member, and wherein the engagement wall portion extends beyond the width of the spacer wall portion on both sides thereof.

4. A shelf support system as defined in claim 3, wherein the engagement wall portion extends away from the spacer wall portion at a gradually increasing incline with respect to the inwardly extending wall portion of the shelf member when the support bracket is connected to the shelf member.

5. A shelf support system as defined in claim 1, wherein the U-shaped mounting flange of the support bracket includes a generally horizontally extending wall portion connected to the upwardly extending connection wall, and wherein the width of the horizontally extending wall portion is substantially equal to the width of the inwardly extending wall portion of the shelf member at the location of the notch.

6. A shelf support system as defined in claim 5, wherein the width of the inwardly extending wall portion of the shelf member at locations other than the notch is greater than the width of the horizontally extending wall portion of the U-shaped mounting flange.

7. A shelf support system as defined in claim 1, wherein the support bracket includes a vertically extending attachment wall having attachment means for connecting the support bracket to a stanchion, and wherein the U-shaped mounting flange of the support bracket is connected to the bottom end of the attachment wall.

8. A shelf support system that includes:

(a) a shelf member that includes a longitudinally extending generally flat support surface, and flanges adjacent the opposite ends of the support surface, respectively, the flanges each including a downwardly extending wall portion and an inwardly extending wall portion connected thereto, with the inwardly extending wall portion having an edge formed with a notch having a predetermined width;

(b) a pair of support brackets for selective attachment to the ends of the shelf member, each support bracket including a vertically extending attachment wall having attachment means for connecting the support bracket to a stanchion and having a generally U-shaped mounting flange connected to the bottom of the attachment wall, the U-shaped mounting flange having an upwardly extending connecting wall that includes a spacer wall portion having a predetermined width that is slightly less than the predetermined width of the notch and includes an engagement wall portion that is connected to the spacer wall portion and that extends beyond the predetermined width of the spacer wall portion at both sides thereof, and the U-shaped mounting flange also includes a horizontally extending wall portion connected to the spacer wall portion and having a width that is substantially equal to the width of the inwardly extending wall portions of the shelf member at the location of the notch; and (c) wherein the U-shaped mounting flange of the support brackets can selectively engage the downwardly extending portions and the inwardly extending portions at each end of the shelf member, with the spacer wall portion of the support bracket disposed in the notch of the shelf member and with the engagement wall portion of the support brackets engaging the inwardly extending wall portions of the shelf member to provide a secure connection between the shelf member and the support brackets.

9. A method of mounting a shelf member on a support bracket comprising the steps of:

(a) providing a shelf member that includes a longitudinally extending generally flat support surface, and a flange adjacent at least one end of the support surface, the flange including a downwardly extending wall portion and an inwardly extending wall portion connected thereto, with the inwardly extending wall portion having an edge formed with a notch having a predetermined width;

(b) providing at least one support brackets including a generally U-shaped mounting flange having an upwardly extending connecting wall that includes a spacer wall portion having a predetermined width and an engagement wall portion that is connected to the spacer wall portion and that extends beyond the predetermined width of the spacer wall portion;

(c) manipulating the support bracket and the shelf member to insert the connecting wall of the support bracket into flange of the shelf member with the spacer wall portion and engagement wall portion initially lying at an angle relative to the inwardly extending wall portion of the shelf member and with the spacer wall portion located adjacent the notch in the inwardly extending wall portion, then rotating the support bracket relative to the shelf member to cause the spacer wall portion to move into the notch and to cause the engagement wall portion to engage the inwardly extending wall portion of the shelf member at each side of the notch to thereby provide a secure connection between the shelf member and the support bracket; and (d) connecting the support bracket to a support.

10. A method of mounting a shelf member on a support as defined in claim 9, wherein the shelf member is provided with two flanges located at opposed ends of the shelf member, wherein two support brackets are provided, wherein one of the support brackets is connected to one of the flanges of the shelf member and the other support bracket is connected to the other flange of the shelf member, and wherein the two support brackets are connected to two support stanchions spaced from one another.

* * * * *